United States Patent [19]

Ueno et al.

[11] Patent Number: 4,695,172

[45] Date of Patent: Sep. 22, 1987

[54] PRINTER WITH DISPLAY FOR DOUBLE-WIDTH CHARACTER

[75] Inventors: Hideo Ueno; Hiroshi Hattori, both of Nagoya; Kumiko Maeda, Ichinomiya; Keiko Yamada, Ama, all of Japan

[73] Assignee: Brother Kogyo Kabushiki Kaisha, Japan

[21] Appl. No.: 813,563

[22] Filed: Dec. 26, 1985

[30] Foreign Application Priority Data

Dec. 29, 1984 [JP] Japan ..... 59-277667

[51] Int. Cl.[4] ..... B41J 3/46

[52] U.S. Cl. ..... 400/83; 400/120

[58] Field of Search ..... 400/83, 120, 121, 122, 400/123, 124, 126

[56] References Cited

U.S. PATENT DOCUMENTS 4,527,914 7/1985 Ueno ..... 400/83 X 4,528,560 7/1985 Bergermann et al. ..... 400/83 X

OTHER PUBLICATIONS

IBM Technical Disclosure Bulletin, "Large Screen Display Compatability Feature", Sheppard et al vol. 23, No. 6, Nov. 1980, pp. 2561–2562.

IBM Technical Disclosure Bulletin, "Efficient Storage for CRT Display Having Alternate Display Modes", Ringle et al, vol. 23, No. 8, Jan. 1981, pp. 3796–3797.

IBM Technical Disclosure Bulletin, "Cursor Left-/Right/Up/Down", Adam et al, vol. 25, No. 1, Jun. 1982, pp. 221–222.

*Primary Examiner*—Ernest T. Wright, Jr.

*Attorney, Agent, or Firm*—Parkhurst & Oliff

[57] ABSTRACT

A printer according to the invention includes a keyboard provided with a cursor key and a mode selection key for selecting a double-width mode, a display for displaying inputted data, a cursor displayed on the display and shifted by operating said cursor key for indicating a position of the data to be processed, a double-width mark displayed on a digit adjacent to a double-width character on the display in the double-width mode, and a controlling means for controlling the double-width mark to be displayed in conjunction with the double-width character and for controlling the cursor when shifted by operating the cursor key to indicate only a double-width character while avoiding a double-width mark.

6 Claims, 10 Drawing Figures

PRINTER WITH DISPLAY FOR DOUBLE-WIDTH CHARACTER

BACKGROUND OF THE INVENTION

1. Field of Industrial Application

This invention relates to a printer which can print a double-width character with a display controlled by such a microprocessor unit that the double-width character can be displayed.

2. Prior Art

In small-sized printers, liquid-crystal displays are usually used for displayiing data. In many cases, as display sections for each digit are separated from each other on the liquid-crystal displays, the double-width data cannot be indicated as they are. For that reason, there have been developed liquid-crystal displays which are provided with continuous digit display sections so that they can display double-width data. Such displays, however, require character generators for double-width characters and double-width cursors, and therefore require more sophisticated softwares such as programs for controlling them. Thus, the liquid-crystal displays with continuous display sections, which are expensive in themselves, have led to substantial raises in cost as a whole.

SUMMARY OF THE INVENTION

An object of this invention is to provide a printer with a display in which double-width marks can be displayed on the display in conjunction with double-width characters without being separated therefrom and the double-width characters and marks can be displayed clearly on the display even if the display is an inexpensive type having a small number of digits to be displayed on the display and having separate display sections for each digit, whereby the cost as a whole can be lowered, and in which a cursor is displayed to indicate only double-width characters while avoiding double-width marks, whereby desired character data can be corrected without errors.

A printer which can print a double-width character with a display for a double-width character including:

a keyboard 8 having cursor leftward and rightward shifting keys 11 and 12, a group of character keys 10 and a double-width mode selection key 13, the key board 8 generating a cursor position control signal, a character signal and a double-width mode signal in accordance with depression of the cursor keys 11 and 12, each of the group of character keys 10 and the mode selection key 13 respectively;

a display 9 displaying the preset number of characters and marks;

a display control means 21 for displaying each character on the display 9 according to the character signal from the keyboard 8 and for displaying each character corresponding to the character signal which is generated in accordance with depression of each of the group of character keys 10 in a position which a cursor 15 of the display 9 indicates together with a double-width mark 17 in an adjacent position during the generation of the double-width mode signal; and the display control means 21 shifting the cursor 15 leftward and rightward according to the cursor position control signal which is generated in accordance with depression of the cursor leftward and rightward shifting key 11 and 12 respectively, and making the cursor 15 jump the position of the double-width mark 17 to indicate the next character.

Accordingly, in the printer according to the present invention, double-width character and mark are shifted in conjunction on the display as the character data is inputted, and removed in conjunction from the display while the corresponding double-width character is printed. For correcting the character data, the cursor is shifted leftward or rightward on the display by operating the cursor key so that the cursor indicates only the double-width character while avoiding the double-width mark.

BRIEF DESCRIPTION OF DRAWINGS

A more complete appreciation of the invention and many of the attendant advantages thereof will be readily obtained as the same becomes better understood by reference to the following detailed description when considered in connection with the accompanying drawing.

DETAILED DESCRIPTION OF PREFERRED EMBODIMENT

Figure 1:
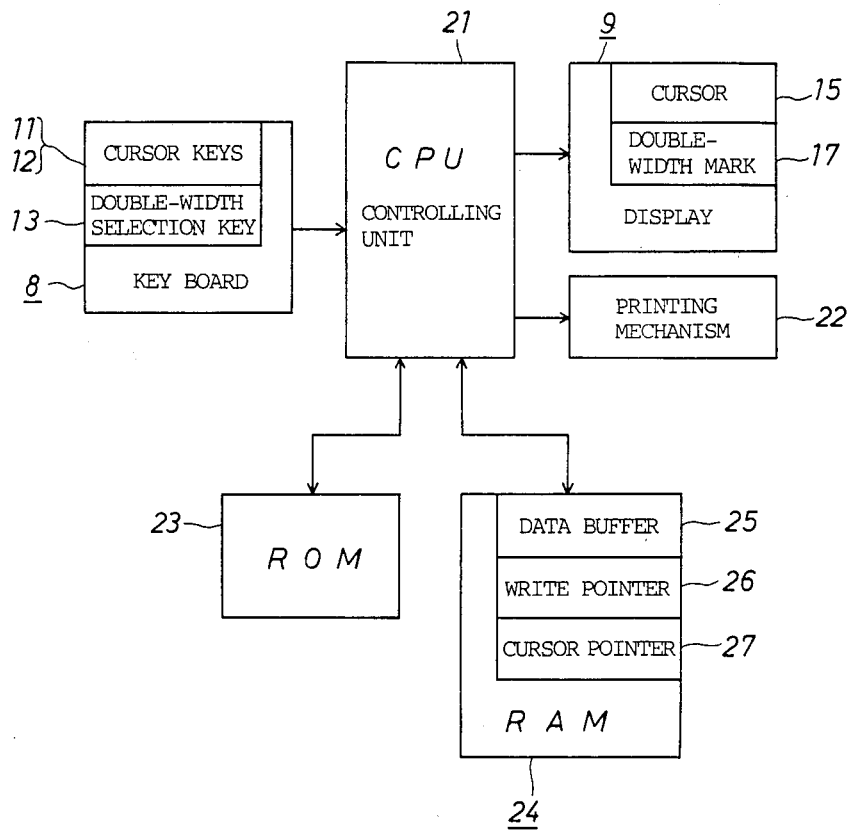
FIG. 1 is a block diagram showing the electronic circuit of a printer embodying the present invention.

Referring now to the drawings, wherein like reference numerals designate identical or corresponding parts throughout the several views.

Figure 2:
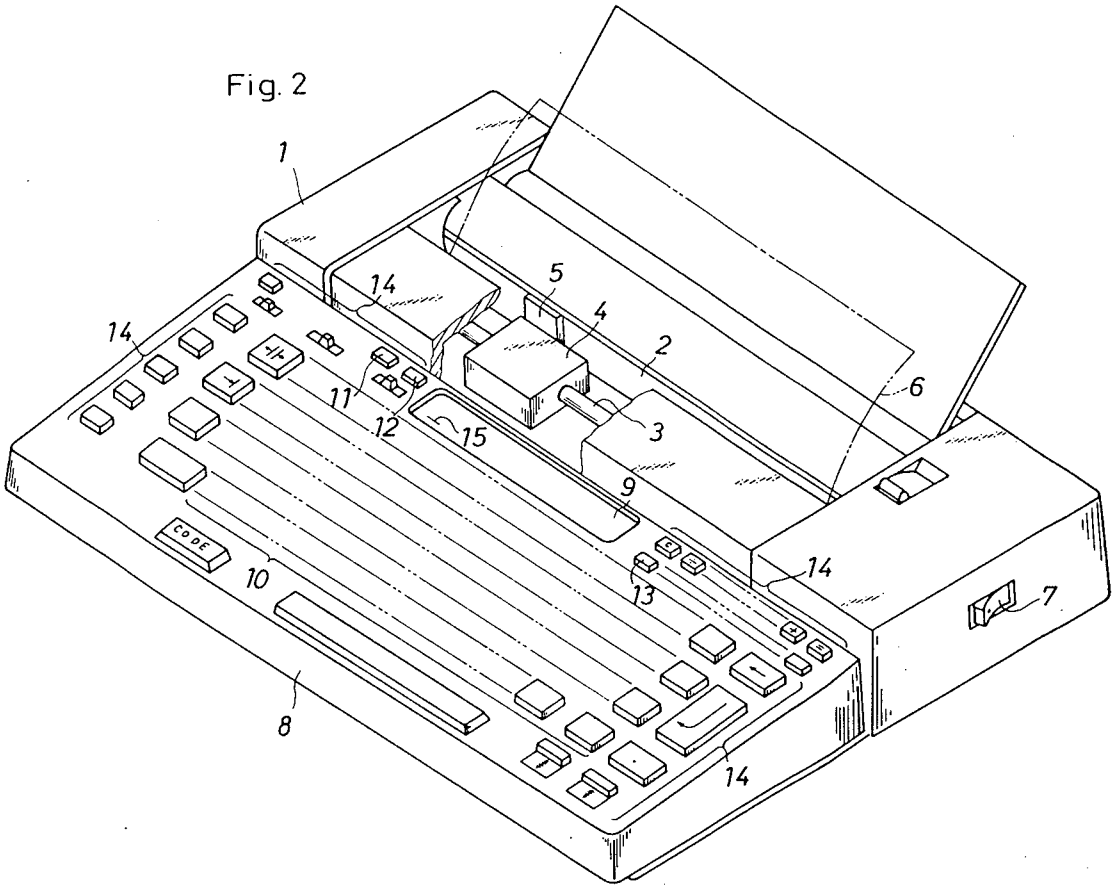
FIG. 2 is a perspective view showing an outer construction of the printer.

In a printer of this embodiment, as shown in FIG. 2, a platen 2 is supported in the rear side portion of a body case 1, and a guide rod 3 is arranged in front thereof so as to extend in parallel with the platen 2. A carriage 4 is supported on the guide rod 3 so as to be movable in the transverse directions and rotatable about the guide rod 3. A thermal head 5 is mounted on the carriage 4 so as to be movable along with rotation of the carriage 4 between a position where it is pressed against heat-sensitive paper 6 and an released position where it is apart from the heatsensitive paper 6. A power supply switch 7 is provided on a side of the body case 1.

A keyboard 8 is provided in the front portion of the body case 1, and a liquid-crystal display (LCD) 9 is provided on the upper surface thereof, the display 9 being adapted to display fifteen digits, less than the maximum number of digits to be printed in one line. In front of the display 9 on the keyboard 8, arranged are a group of character keys 10 consisting of a multiplicity of alphabet keys, numeral keys and the like. On the left-hand and the right-hand sides of the display 9 and the group of character keys 10 on the keyboard 8, arranged are a group of function keys 14 consisting of a cursor leftward shifting key 11, a cursor rightward shifting key 12, a mode selection key 13 for selecting a double-width mode and the like.

Figure 4A:
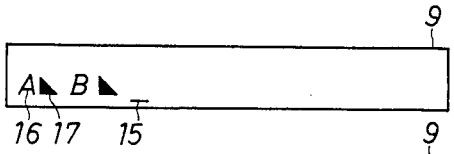
FIGS. 4A–C and FIGS. 5A–D illustrate how the display displays in actual operation.
Figure 4B:
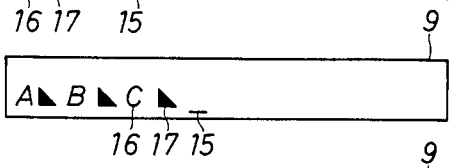
Figure 4C:
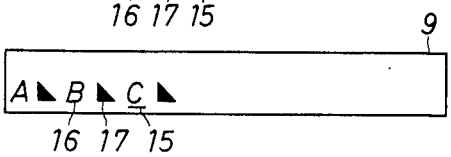

A cursor 15 for indicating a processing position in data as indicated on the display 9 as shown in FIGS. 4A–C is adapted to be shifted leftward or rightward by operating the cursor leftward shifting key 11 or the cursor rightward shifting key 12. When a double-width mode is selected by operating the mode selection key 13, a double-width mark 17 is displayed, as shown in FIGS. 4A–C, on the lower digit adjacent to the double-width character 16 which is displayed on the display 9 as data are inputted from the group of character keys 10.

The electronic circuit of the printer having an outer construction as mentioned above will now be described with reference to FIG. 1.

In FIG. 1, the reference numeral 21 indicates a central processing unit (CPU), which is connected with the keyboard 8 and the display 9 as well as with a printing mechanism 22 consisting of the platen 2, the carriage 4, the thermal head 5 and the like. The CPU 21 is further connected with a read-only memory (ROM) 23 in which a program for controlling the operation of the printer is stored and a random-access memory (RAM) 24.

The RAM 24 is provided with a data buffer 25 for temporarily storing character data and function data to be included in one line of printing. The CPU 21 makes the data buffer 25 of the RAM 24 successively store the data corresponding to the characters such as alphabets or numerals inputted from the keyboard 8, while reading out from the ROM 23 pattern data corresponding to the code data thereof and supplies them to the display 9 and to printing mechanism 22. As the display 9 displays characters or the like based on the code data, the carriage 4, the thermal head 5 and the like in the printing mechanism 22 are driven to print them.

The RAM 24 is provided with a write pointer 26 for indicating a position to write inputted data in the data buffer 25 and with a cursor pointer 27 for indicating a position of the cursor 15 to be displayed by the display 9. The CPU 21 gives an increment to a write pointer 26 and the cursor pointer 27 each time data are inputted from the keyboard 8. When the address indicated by the write pointer 26 reaches the right-hand end of the display 9, the CPU 21 shifts the data as displayed on the display 9 shifted leftward, and prints the characters corresponding to the data removed from the display 9 by the shift. If the display 9 displays a double-width character 16 and a double-width mark 17 adjacent to each other, the CPU 21 controls them so that they are shifted and displayed in conjunction. Further, when the cursor leftward shifting key 11 or cursor rightward shifting key 12 is operated, the CPU 21 controls the shift of the cursor 15 so that the cursor 15 always indicates only the double-width character 16 while avoiding the double-width mark 17 on the display 9.

Processing of the printer of this invention will now be described with reference to FIGS. 3–5.

Figure 3:
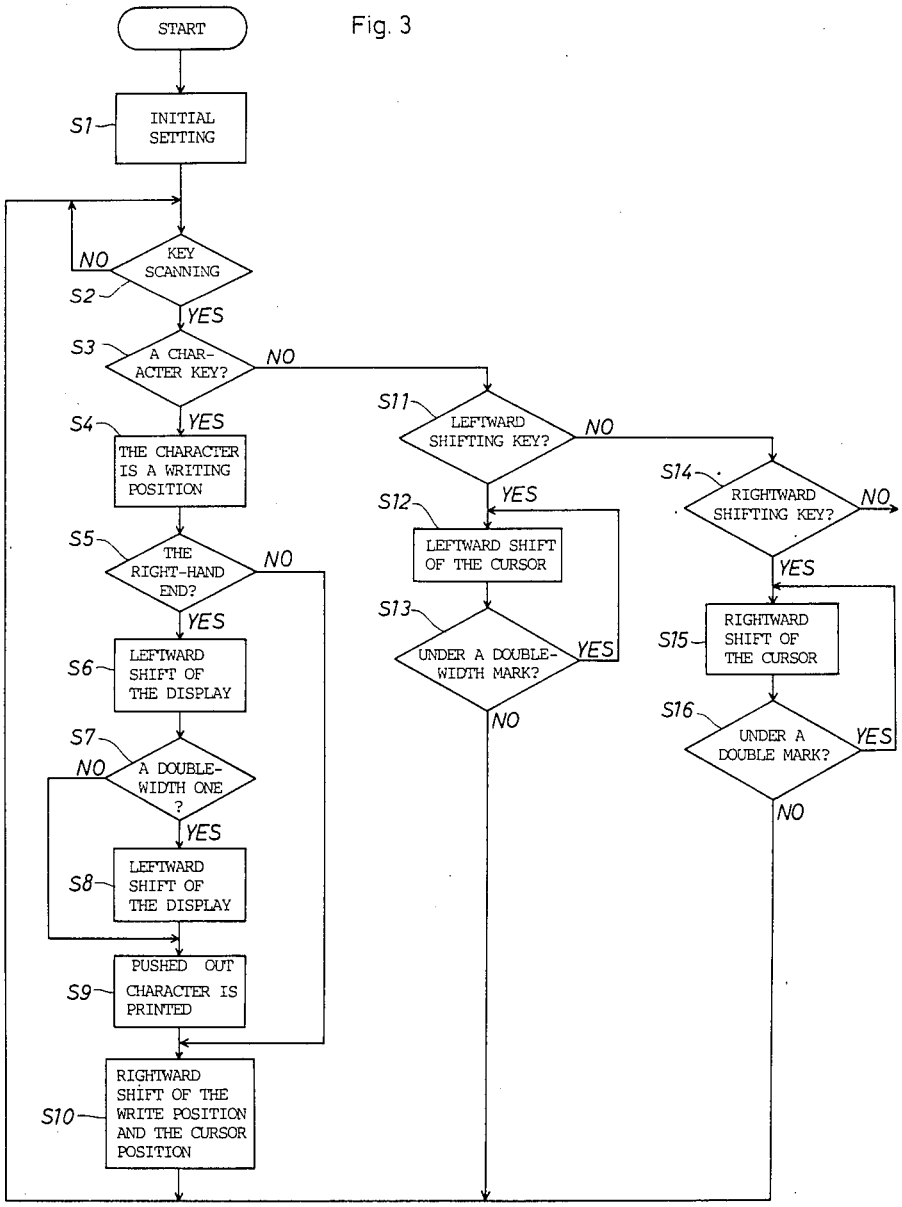
FIG. 3 is a flowchart of a program of the printer.

In the printer according to the invention, the main program as shown in FIG. 3 is started upon closing of the power supply switch 7. In the step S1, contents in the data buffer 25 and the pointers 26 and 27 of the RAM 24 are initialized, and in the step S2 the printer waits for data to be inputted by operating a key on the keyboard 8. When data are inputted from the keyboard 8, the inputted data are discriminated in the step S3 whether or not it is one of character keys 10. If the result is YES, the inputted data are written in an address of the data buffer 25 indicated by the write pointer 26 and the character corresponding to the data is displayed on the display 9, in the step S4.

If a letter "C" is inputted on condition that the display 9 displays as shown in FIG. 4A, for example, the letter "C" is displayed following to the characters displayed on the display 9 as shown in FIG. 4B. If the double-width mode is selected with the double-width selection key 13 on the keyboard 8 when the letter "C" is inputted, a double-width mark 17 is also displayed on the lower digit adjacent to the double-width letter "C".

Then, in the step S5 as shown in FIG. 3, it is determined whether the write position as indicated by the write pointer 26 is located at the right-hand end of the display 9, and if it results in YES, the processing proceeds to the step S6, while if NO, the processing proceeds to the step S10, jumping the steps from S6 to S9. In the step S6, the data displayed on the display 9 are shifted leftward by one place respectively and in the step S7 it is determined whether or not the data pushed out from the display 9 is the double-width character 16. If the result is YES, the data displayed on the display 9 are further shifted leftward by one place in the step S8, and thereafter the processing proceeds to the step S9. If NO, however, the processing jumps the step S8 and proceeds to the step S9 where a character corresponding to the data pushed out from the display 9 is printed by the printing mechanism 22. In the step S10, the write pointer 26 and the cursor pointer 27 are given an increment, whereby the write position and the cursor position are shifted rightward by one place.

Figure 5A:
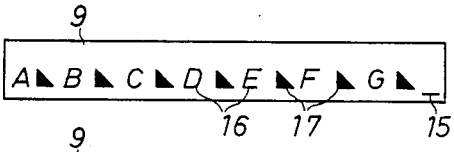
Figure 5B:
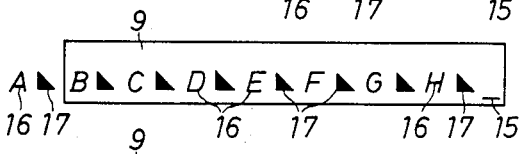
Figure 5C:
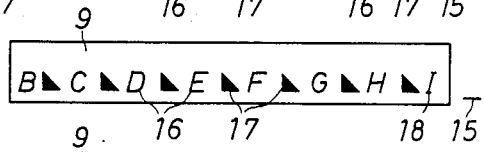
Figure 5D:
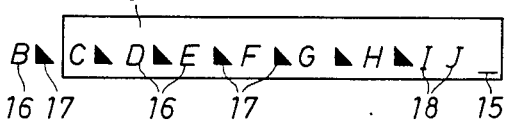

Accordingly, if a letter "H" is inputted in the double-width mode on condition that the display 9 displays as shown in FIG. 5A, for example, the data displayed on the display 9 are shifted leftward by two places as shown in FIG. 5B, whereby the double-width letter "A" and the double-width mark 17 displayed adjacent thereto are pushed out in conjunction from the display 9 and the letter "A" is printed in a double width. If a letter "I" is inputted in a normal mode on the condition as shown in FIG. 5B, no data displayed on the display 9 is shifted as shown in FIG. 5C, and a normal letter "I" 18 is displayed on the right-hand end of the display 9. If a letter "J" is inputted in a normal mode on the condition as shown in FIG. 5C, the data displayed on the display 9 are shifted leftward by two places, whereby the double-width letter "B" 16 and the double-width mark 17 are pushed out in conjunction from the display 9 and the letter "B" is printed in a double width.

Meanwhile, in the program as shown in FIG. 3, if the result is NO in the step S3, that is, if the inputted data are not from the group of character keys 10 on the keyboard 8, the processing proceeds to the step S11 where it is determined whether or not the data are inputted by operating the cursor leftward shifting key 11. If the result is YES, the cursor pointer 27 is given a decrement when the data exist on the digit higher than the address of the data buffer 25 indicated by the cursor pointer 27 and the cursor 15 is thereby shifted by one place on the display 9 in the step 12. In the step S13, it is determined whether or not the cursor 15 is located under the double-width mark 17. If the result is YES, the processing returns to the step S12 and the cursor is further shifted leftward by one place, while if NO, the processing returns to the step S2 for waiting for another key operation.

If the result of the determination in the step S11 is NO, that is, if the data is not inputted by operating the cursor leftward shifting key 11, the processing proceeds to the step S14 where it is determined whether or not the data is inputted by operating the cursor rightward shifting key 12. If the result is NO, the processing proceeds to other operations, while if YES, the cursor pointer 27 is given a decrement when the data exist on the digit lower than the address of the data buffer 25 indicated by the cursor pointer 27, whereby the cursor 15 is shifted rightward by one place on the display 9 in the step S15. In the step S16, it is determined whether or not the cursor 15 is located under the double-width mark 17. If the result is YES, the processing returns to the step S15 where the cursor 15 is further shifted rightward by one place, while if NO, the processing returns to the step S2 for waiting for another key operation.

Accordingly, if the cursor leftward shifting key 11 is operated on the keyboard 8 on condition that the display 9 displays as shown in FIG. 4B, for example, the cursor 15 is shifted to the position to indicate the double-width letter "C" 16 whle avoiding the double-width mark 17 as shown in FIG. 4C. If the cursor rightward shifting key 12 is operated when the cursor 15 is on a higher digit, the cursor 15 is shifted, also avoiding the double-width mark 17.

In the printer as described above, a double-width character is always displayed in conjunction with a double-width mark 17 if the double-width mode is selected, and therefore inputted double-width characters 16 can be confirmed without errors even with an inexpensive small-sized display 9 on which display sections for each digit are separated. Further, since the cursor 15 always indicates only a double-width character 16 while avoiding a double-width mark 17, a desired double-width character 16 can be corrected without errors and without requiring any cursor or character generator especially for double-width characters 16.

Obviously, numerous modifications and variations of the present invention are possible in the light of the above teachings. It is therefore understood that within the scope of the appended claims, the invention may be practiced otherwise than as specifically described herein.

What is claimed is:

1. A printer which can print a double-width character with a display for a double-width character comprising:

a keyboard having cursor leftward and rightward shifting keys, a group of character keys and a double-width mode selection key, said keyboard generating a cursor position control signal, a character signal and a double-width mode signal in accordance with depression of said cursor keys, each of said group of character keys and said mode selection key respectively;

a display for displaying a preset number of characters and marks;

display control means for displaying each character on said display according to said character signal from said keyboard and for displaying each character corresponding to said character signal in a position which a cursor of said display indicates together with a double-width mark in an adjacent position during said double-width mode; and said display control means shifting said cursor leftward and rightward according to said cursor position control signal which is generated in accordance with depression of said cursor leftward and rightward shifting key respectively, and making said cursor jump the position of said double-width mark to indicate the next character.

2. A printer which can print a double-width character with a display for a double-width character according to claim 1, further comprising detection means for generating a display full signal on condition that the character and said double-width mark which are displayed in the order reach a preset position at an end of said display, and for extinguishing said double-width mark together with the character which is displayed in the preset position at a start end from said display and shifting the displayed character and mark on said display to the start end on condition that said display full signal is generated during said double-width mode.

3. A printer which can print a double-width character with a display for a double-width character according to claim 1, further comprising memory means for storing said character signal in a preset memory in accordance with depression of said group of character keys on said keyboard.

4. A printer which can print a double-width character with a display for a double-width character according to claim 1, further comprising memory means for storing pattern data to call a character which is to be displayed corresponding to said character signal.

5. A printer which can print a double-width character with a display for a double-width character according to claim 2, further comprising printing means for printing out the double-width character instead of the extinguished character together with said double-width mark from said display on printing paper.

6. A printer which can print a double-width character with a display for a double-width character according to claim 3, wherein said memory means comprises:

a data buffer for storing said character signals;

a write pointer which indicates a stored position of said character signals;

a cursor pointer which indicates a position of said cursor; and means for controlling said write pointer and said cursor pointer whenever the signal is inputted from said keyboard.

* * * * *